US008269091B2

(12) United States Patent
Streich et al.

(10) Patent No.: US 8,269,091 B2
(45) Date of Patent: Sep. 18, 2012

(54) SOUND EVALUATION DEVICE AND METHOD FOR EVALUATING A DEGREE OF CONSONANCE OR DISSONANCE BETWEEN A PLURALITY OF SOUNDS

(75) Inventors: Sebastian Streich, Delft (NL); Takuya Fujishima, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 670 days.

(21) Appl. No.: 12/456,553

(22) Filed: Jun. 18, 2009

(65) Prior Publication Data

US 2009/0316915 A1 Dec. 24, 2009

(30) Foreign Application Priority Data

Jun. 24, 2008 (JP) ..... 2008-164057

(51) Int. Cl.
*A63H 5/00* (2006.01)
*G04B 13/00* (2006.01)
*G10H 7/00* (2006.01)

(52) U.S. Cl. ..... 84/609; 381/56

(58) Field of Classification Search ..... 84/609; 381/56

See application file for complete search history.

(56) References Cited

U.S. PATENT DOCUMENTS 5,504,270 A 4/1996 Sethares
2002/0087565 A1 * 7/2002 Hoekman et al. ..... 707/100

OTHER PUBLICATIONS

Apr. 16, 2010 Office Action from European Patent Office; Application No. 09163450.1; 9 pages.
"Quantified Total Consonance as an Assessment Parameter for the Sound Quality" by Sang Bae Chon, et al. presented on Oct. 5-8, 2006 in San Francisco, CA.

* cited by examiner

*Primary Examiner* — Jeffrey Donels
(74) *Attorney, Agent, or Firm* — Pillsbury Winthrop Shaw Pittman LLP

(57) ABSTRACT

Mask generation section generates an evaluating mask, indicative of a degree of dissonance with a target sound per each frequency along a frequency axis, by setting, for each of a plurality of peaks in spectra of the target sound, a dissonance function indicative of relationship between a frequency difference from the peak and a degree of dissonance with a component of the peak. Index calculation section collates spectra of an evaluated sound with the evaluating mask to thereby calculate a consonance index value indicative of a degree of consonance or dissonance between the target sound and the evaluated sound.

12 Claims, 6 Drawing Sheets

SOUND EVALUATION DEVICE AND METHOD FOR EVALUATING A DEGREE OF CONSONANCE OR DISSONANCE BETWEEN A PLURALITY OF SOUNDS

BACKGROUND

The present invention relates to a technique for evaluating a degree of consonance or dissonance between a plurality of sounds.

Heretofore, there have been proposed techniques for evaluating a degree of an auditory difference (i.e., consonance or dissonance) between a plurality of sounds. Japanese Patent Application Laid-open Publication No. 2007-316416 (hereinafter referred to as "Patent Literature 1") and International Publication WO 2006/079813 (hereinafter referred to as "Patent Literature 2"), for example, disclose techniques for measuring a difference in pitch between a singing voice sound of a user and a normative sound (i.e., model sound) and correcting the pitch of the singing sound.

However, with the techniques disclosed in Patent Literature 1 and Patent Literature 2, where it is necessary to detect the pitches (fundamental frequencies) of the singing sound and the model sound in order to evaluate a degree of difference between the singing sound and the model sound, there would arise the problem that, if the singing sound and the model sound greatly differ from each other in pitch, a degree of consonance or dissonance between the two sounds can not be evaluated appropriately. Although the foregoing have discussed the prior art problem involved in evaluating singing sounds, a similar problem would arise when evaluating other sounds than singing sounds, such as tones performed by musical instruments.

SUMMARY OF THE INVENTION

In view of the foregoing, it is an object of the present invention to provide an improved sound processing apparatus and program which can evaluate a degree of consonance or dissonance between a plurality of sounds appropriately with high accuracy.

In order to accomplish the above-mentioned object, the present invention provides an improved sound processing apparatus, which comprises: a mask generation section that generates an evaluating mask indicative of a degree of dissonance with a first sound per each frequency along a frequency axis, by setting, for each of a plurality of peaks in spectra of the first sound, a dissonance function indicative of relationship between a frequency difference from the peak and a degree of dissonance with a component of the peak; and an index calculation section that collates spectra of a second sound with the evaluating mask to thereby calculate a consonance index value indicative of a degree of consonance or dissonance between the first sound and the second sound. The term "sound" is used herein to refer to any of desired sounds, including not only a voice uttered by a person but also a tone performed by a musical instrument, operating sound of a machine, etc.

In the sound processing apparatus of the present invention, the evaluating mask, generated by setting a dissonance function for each of a plurality of peaks in spectra of the first sound, is used for calculation of a consonance index value indicative of a degree of consonance or dissonance between the first sound and the second sound. Thus, in principle, the present invention can eliminate the need for detecting the fundamental frequencies of the first and second sounds. As a result, the present invention can evaluate, with high accuracy, a degree of consonance or dissonance between the first and second sounds, regardless of the fundamental frequencies of the first and second sounds.

In a preferred implementation, the spectra of the first sound are supplied as a spectral trajectory comprising a time-series arrangement of spectra, the mask generation section generates a time-series trajectory of the evaluating masks; the spectra of the second sound are supplied as a spectral trajectory comprising a time-series arrangement of spectra, and the index calculation section collates the spectral trajectory of the second sound with the trajectory of the evaluating masks. Because the spectral trajectory of the second sound is collated with the trajectory of the evaluating masks, the present invention can evaluate degrees of consonance or dissonance between the first and second sounds in view of changes over time of the first and second sounds.

Preferably, the sound processing apparatus of the present invention further comprises: a correlation calculation section that calculates a correlation value between the spectra of the first sound and the spectra of the second sound; and a shift processing section that shifts the spectra of the second sound, in a direction of the frequency axis, by a given frequency difference such that the correlation value calculated by the correlation calculation section becomes maximum. The index calculation section collates the spectra of the second sound, having been processed by the shift processing section, with the evaluating mask. Because the spectra of the second sound are shifted in the direction of the frequency axis, by a given frequency difference such that the correlation value between the first and second sounds becomes maximum and then collated with the evaluating mask, the present invention can evaluate, with high accuracy, a degree of consonance or dissonance between the first and second sounds, for example, even where the first and second sounds differ from each other in pitch range.

Preferably, the correlation calculation section includes: a band processing section that generates a band intensity distribution of the first sound indicative of a spectral intensity of each predetermined unit band of the first sound and generates a band intensity distribution of the second sound indicative of a spectral intensity of each predetermined unit band of the second sound; and an arithmetic operation processing section that calculates, per each frequency difference corresponding to the unit band, a correlation value between the band intensity distribution of the first sound and the band intensity distribution of the second sound. Because a correlation value between the band intensity distribution of the first sound and the band intensity distribution of the second sound is calculated in the present invention, the correlation value calculation processing can be simplified as compared to a case where, for example, a correlation value between the frequency spectra of the first and second sounds is calculated.

In a further preferred implementation, the correlation calculation section further includes a first correction value calculation section that calculates, for each of the frequency differences between the first sound and the second sound, a first correction value corresponding to a sum of the intensities in a portion of the band intensity distribution of the first sound that does not overlap with the band intensity distribution of the second sound; a second correction value calculation section that calculates, for each of the frequency differences between the first sound and the second sound, a second correction value corresponding to a sum of the intensities in a portion of the band intensity distribution of the second sound that does not overlap with the band intensity distribution of the first sound; and a correction section that, for each of the frequency differences, subtracts the first and second correction values from the correlation value calculated by the arithmetic operation processing section and thereby corrects the correlation value. The aforementioned arrangements of the present invention can avoid the inconvenience that the correlation value increases despite high intensities in a portion of the band intensity distribution of one of the first and second sounds that does not overlap with the band intensity distribution of the other sound, and thus, the present invention allows the pitches of the first and second sounds to highly coincide with each other.

Preferably, when a plurality of the dissonance functions overlap each other on the frequency axis, the mask generation section generates the evaluating mask by selecting a maximum value of the degrees of dissonance at the frequency in the plurality of the dissonance functions. Thus, even where adjoining peaks in the spectra of the first sound are located close to each other so that a plurality of the dissonance functions overlap on the frequency axis, the present invention can generate an evaluating mask having degrees of dissonance of the individual peaks properly set therein.

Preferably, the mask generation section generates the evaluating mask by adding or subtracting a predetermined value to or from the degree of dissonance of the dissonance function set on the frequency axis. Because the degree of dissonance in the evaluating mask can be appropriately adjusted through the addition or subtraction of the predetermined value, the present invention can generate an evaluating mask suited for collation with the spectra of the second sound.

Preferably, the index calculation section includes: an intensity identification section that identifies a maximum value of amplitudes of the peaks in the spectra of the second sound; a collation section that multiplies, for each of the frequencies, each of the amplitude of the spectral trajectory of the second sound and each numerical value of the evaluating mask, to thereby output a product for each of the frequencies; and an index determination section that determines a consonance index value by dividing a maximum value of the products, outputted by the collation section, by the maximum amplitude value identified by the intensity identification section. Because the maximum value of the products, outputted by the collation section, is normalized through the division by the maximum value of the amplitudes of the peaks in the spectra of the second sound, the present invention can calculate an appropriate consonance index value while effectively reducing influence of amplitude levels of the spectra of the second sound.

Preferably, the index calculation section calculates the consonance index value for each of a plurality of cases where the spectra of the second sound have been shifted by different shift amounts in the direction of the frequency axis, and the sound processing apparatus of the invention further comprises a tone pitch adjustment section that changes a tone pitch of the second sound by a given shift amount such that the degree of consonance indicated by the consonance index value becomes maximum (or the degree of dissonance becomes minimum). Because the tone pitch of the second sound is adjusted by a shift amount corresponding to the consonance index value, the present invention can generate a second sound highly consonant with the first sound.

Preferably, the index calculation section collates each of a plurality of the second sounds with the evaluating mask, to thereby calculate a consonance index value for each of the second sounds. Because a consonance index value is calculated individually for each of the second sounds, the present invention can select, from among the plurality of the second sounds, a sound having a high degree of consonance or dissonance with the first sound.

The aforementioned sound processing apparatus of the present invention may also be constructed and implemented as a computer-implemented method. Also, the present invention may be implemented by hardware (electronic circuitry), such as a DSP (Digital Signal processor) dedicated to the inventive sound processing, as well as by cooperation between a general-purpose arithmetic operation processing device, such as a CPU (Central processing Unit) and a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1:
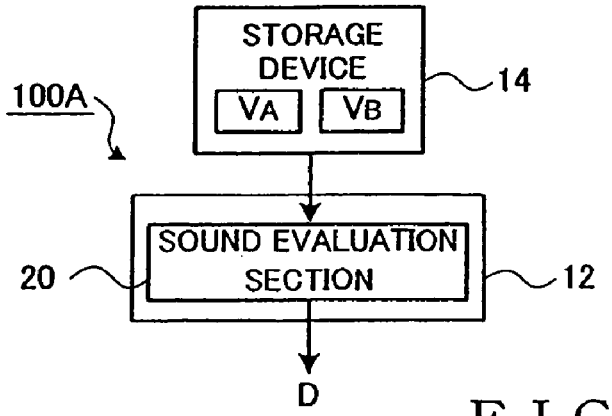
FIG. 1 is a block diagram of a first embodiment of a sound processing apparatus of the present invention.

FIG. 1 is a block diagram of a first embodiment of a sound processing apparatus of the present invention. As shown, the sound processing apparatus 100A is implemented by a computer comprising an arithmetic operation processing device 12 and a storage device 14. The arithmetic operation processing device 12 performs a particular function (sound evaluation section 20) by executing a program. The storage device 14 stores therein programs to be executed by the arithmetic operation processing device 12, and data to be used by the arithmetic operation processing device 12.

As shown in FIG. 1, the storage device 14 stores therein a plurality of sounds V (VA, VB). Each of the voices is stored in the storage device 14 in the form of digital data indicative of a waveform of the time domain. Each of the sounds V is a singing sound or performance tone of a musical instrument in a characteristic portion (e.g., two to four measures) of a music piece. However, sounds V having a harmonic structure are suited for processing by the sound processing apparatus 100A.

The arithmetic operation processing device 12 functions as a sound evaluation section 20. The sound evaluation section 20 calculates an index value of consonance D between one of the sounds VA (hereinafter referred to as "target sound VA") and another one of the sounds VB (hereinafter referred to as "evaluated sound VB") stored in the storage device 14. The index value of consonance (hereinafter referred to as "consonance index value") D is a numerical value indicative of a degree of dissonance, with the target sound VA, of the evaluated sound VB which a human listener auditorily perceives when that the target sound VA and evaluated sound VB are reproduced in parallel or in succession. There is a tendency that the greater the consonance index value D of the evaluated sound VB, the more difficult for the evaluated sound VB to be musically consonant with the target sound VA (i.e., the smaller the consonance index value D of the evaluated sound VB, the easier for the evaluated sound VB to be musically consonant with the target sound VA). The consonance index value D calculated by the sound evaluation section 20 is output, for example, from a display device or sounding device as an image or sound. User can recognize a degree of dissonance between the target sound VA and the evaluated sound VB by knowing the consonance index value D. Although the instant embodiment will be described assuming that the target sound VA and the evaluated sound VB have a same time length, these sound VA and VB may have different time lengths.

Figure 2:
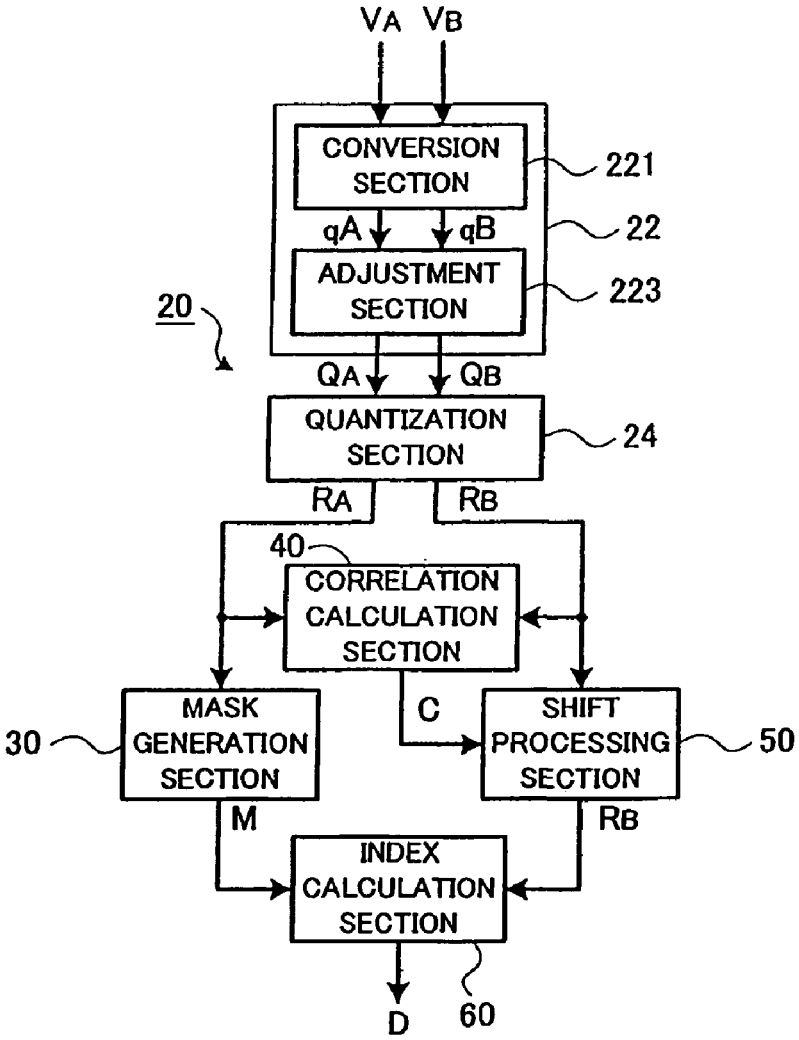
FIG. 2 is a block diagram of a sound evaluation section provided in the first embodiment of the sound processing apparatus.

FIG. 2 is a block diagram of the sound evaluation section 20. As shown in FIG. 2, the sound evaluation section 20 comprises a frequency analysis section 22, a quantization section 24, a mask generation section 30, a correlation calculation section 40, a shift processing section 50, and an index calculation section 60. The individual components of the sound evaluation section 20 may be provided distributively on a plurality of integrated circuits or may be implemented by an electronic circuit (DSP) dedicated to the inventive sound processing.

Figure 3:
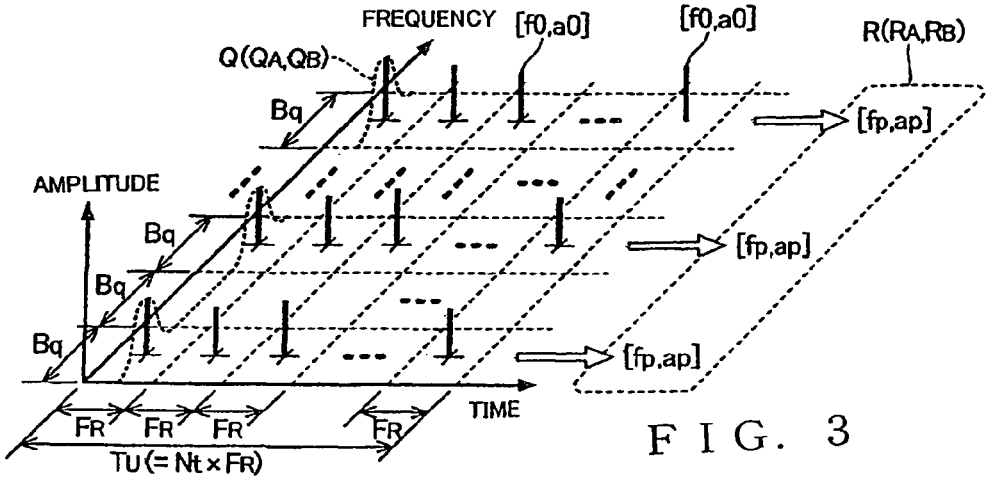
FIG. 3 is a conceptual diagram explanatory of how spectral trajectories are generated.

FIG. 3 is a conceptual diagram explanatory of behavior of the frequency analysis section 22 and quantization section 24. The frequency analysis section 22 of FIG. 2 calculates frequency spectra Q (i.e., frequency spectra QA of the target sound VA and frequency spectra QB of the evaluated sound VB) for each of a plurality of frames FR obtained by dividing the sounds (target sound VA and evaluated sound VB) on the time axis.

As shown in FIG. 2, the frequency analysis section 22 includes a conversion section 221 and an adjustment section 223. The conversion section 221 calculates frequency spectra qA of the target sound VA and frequency spectra qB of the evaluated sound VB for each of the time-axial frames FR, preferably using the short-time Fourier transform that utilizes a Hanning window. The adjustment section 223 adjusts amplitudes of the frequency spectra qA and frequency spectra qB to thereby generate the frequency spectra QA and frequency spectra QB. More specifically, the adjustment section 223 calculates the frequency spectra QA by adjusting the amplitudes of the frequency spectra qA in such a manner that amplitude values converted into logarithmic values are distributed over the entirety of a predetermined range (e.g., −2.0 dB to +2.0 dB). The frequency spectra QB of the evaluated sound VB are calculated from the frequency spectra qB in a similar manner (i.e., through similar amplitude adjustment) to the frequency spectra QA of the target sound VA.

The quantization section 24 of FIG. 2 generates spectral trajectories R (RA and RB) by quantizing the frequency spectra QA and QB in terms of both the time axis and the frequency axis. The spectral trajectory RA is calculated from the frequency spectra QA of the target sound VA, and the spectral trajectory RB are calculated from the frequency spectra QB of the target sound VB, First, as shown in FIG. 3, the quantization section 24 divides the frequency spectra Q, represented in cents, into bands Bq, each having a predetermined width (e.g., 10 cents), on the frequency axis and identifies, for each band Bq where a peak p of the frequency spectra Q is present, a frequency f0 and amplitude a0 of the peak p. Further, for each band Bq where a plurality of peaks p are present, the quantization section 24 identifies a frequency f0 and amplitude a0 of, for example, only the peak p having the greatest amplitude a0.

Second, as also shown in FIG. 3, the quantization section 24 calculates a frequency f0 and amplitude a0 of peaks p per each unit portion TU comprising Nt (Nt represents a number, such as twenty) frames FR. More specifically, the frequency fp is a numerical value obtained by averaging the frequencies f0 of the peaks p of the Nt frames within the unit portion TU, and the amplitude ap is a numerical value obtained by averaging the amplitudes a0 of the peaks p of the Nt frames within the unit portion TU. The spectral trajectory RA of the target sound VA comprises a plurality of sets of the frequencies fp and amplitudes ap calculated for the Nt frequency spectra QA within the unit portion TU, and the spectral trajectory RB of the evaluated sound VB comprises a plurality of sets of the frequencies fp and amplitudes ap calculated for the plurality of frequency spectra QB within the unit portion TU. The spectral trajectory RA of the target sound VA and the spectral trajectory RB of the evaluated sound VB are generated per each unit portion TU in a time-serial manner.

The mask generation section 30 of FIG. 2 generates an evaluating mask M from the spectral trajectory RA of the target sound VA. Such an evaluating mask M is generated for each of the spectral trajectories RA of the target sound VA sequentially generated by the quantization section 24, i.e. generated for each of the unit portions TU. As shown (E) of FIG. 4, the evaluating mask M is a train of numerical values (function) defining degrees of dissonance Dmask(f) with the target sound VA along the frequency axis ("frequency f"). The degree of dissonance Dmask(f) indicates a degree of dissonance between the target sound VA and a sound of the frequency f in question. If the evaluated sound VB contains a lot of components of high degrees of dissonance Dmask(f) in the evaluating mask M, then it is evaluated as a sound dissonant with the target sound VA. Note that the evaluating mask M may be generated for each predetermined plurality of the unit portions rather than for each one of the unit portions.

Figure 4:
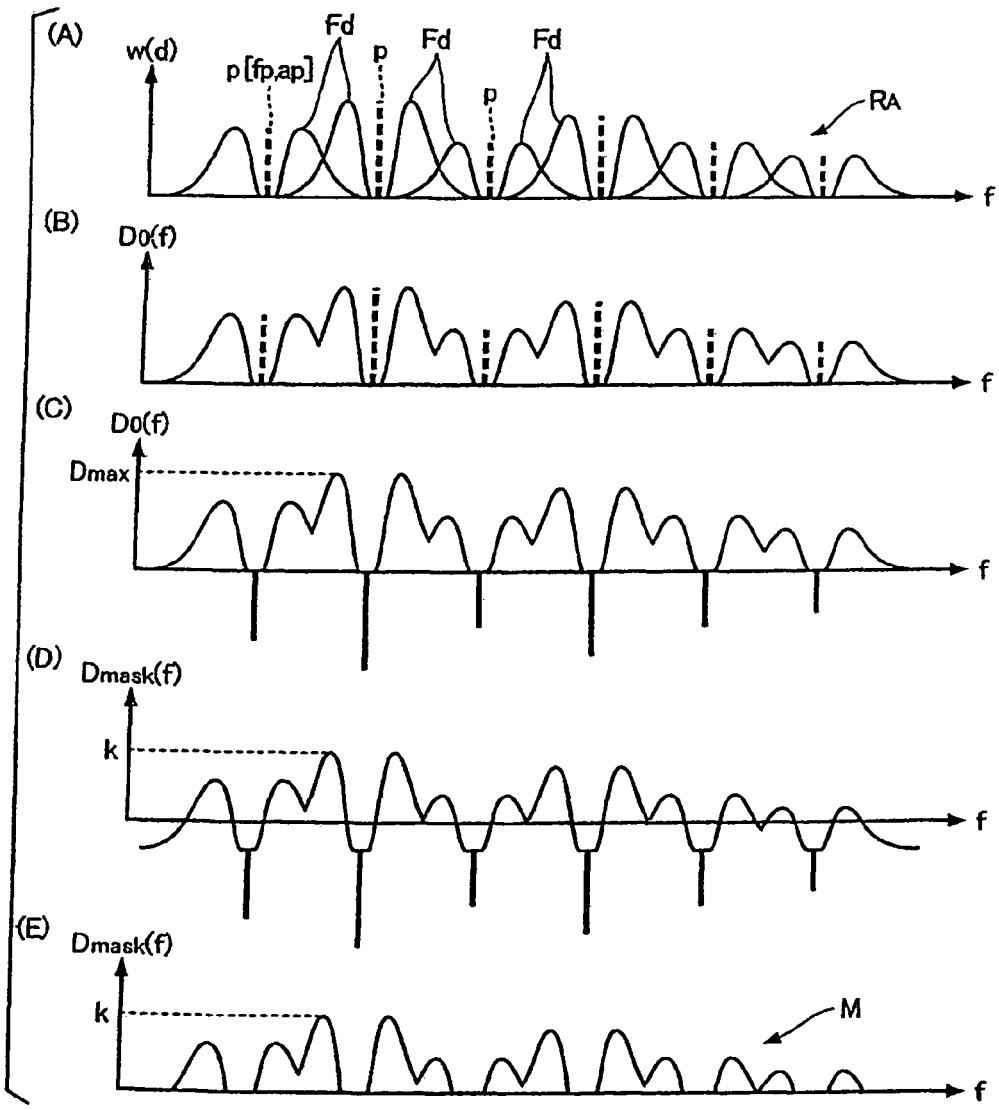
FIG. 4 is a conceptual diagram explanatory of how evaluating masks are generated.
Figure 5:
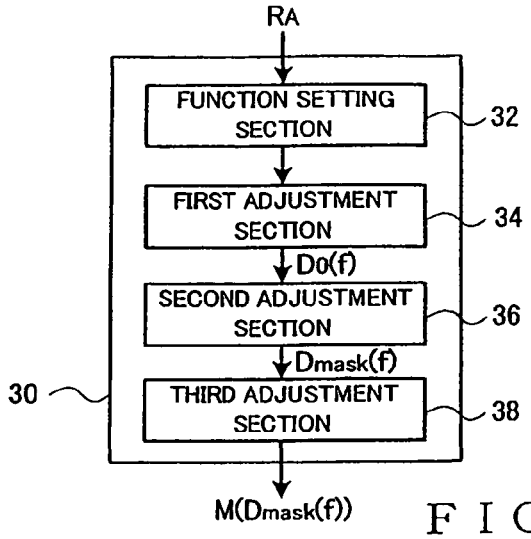
FIG. 5 is a block diagram of a mask generation section provided in the first embodiment of the sound processing apparatus.

FIG. 5 is a block diagram of the mask generation section 30, which includes a function setting section 32 and first, second and third adjustment sections 34, 36 and 38. The function setting section 32, as shown in (A) of FIG. 4, sets a dissonance function Fd for each of a plurality of peaks p (frequencies fp and amplitudes ap) in the spectral trajectory RA of the target sound VA. The dissonance function Fd is a function of a frequency difference d (d=|f−fp|) that defines a degree of dissonance w(d) between a component of a peak p in the spectral trajectory RA of the target sound VA and a sound having a frequency difference d(cent) from the frequency fp of the peak p. More specifically, the degree of dissonance w(d) is defined as follows:

$$w(d) = \begin{cases} a_p \cdot \left\{ \frac{1}{2} \cdot \cos(\log_{10}(d) \cdot 2\pi) + \frac{1}{2} \right\} & (30 < d < 300) \\ 0 & (\text{otherwise}) \end{cases} \quad (1)$$

Figure 6:
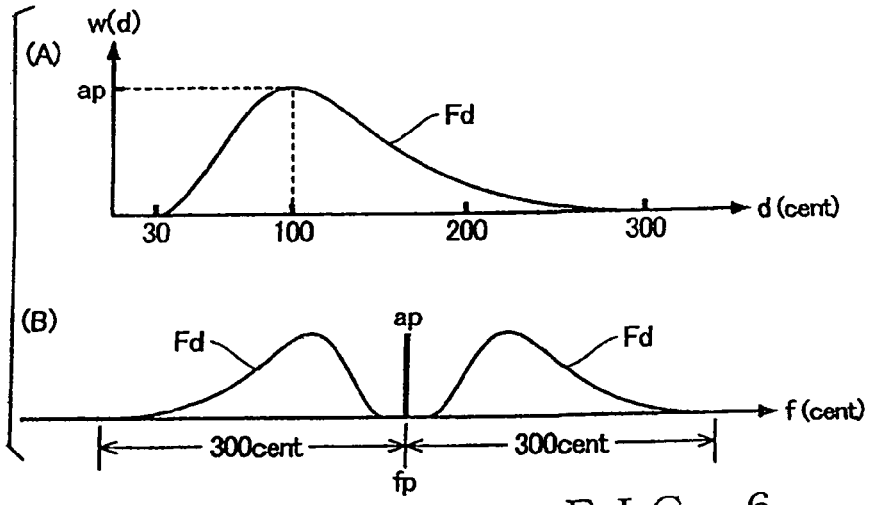
FIG. 6 is a conceptual diagram explanatory of how dissonance functions are set.

(A) of FIG. 6 is a graph of the dissonance function Fd defined by mathematical expression (1) above. As shown, the degree of dissonance w(d) varies nonlinearly, in accordance with the frequency difference d, within a range from 30 cents to 300 cents so that it becomes the maximum when the frequency difference d is 100 cents. Further, because there is a tendency that, of the spectral trajectory RA of the target sound VA, a component having a greater peak amplitude ap presents a greater degree of dissonance with another sound as perceived by a human listener. As indicated in mathematical expression (1) above, the degree of dissonance w(d) set for the peak p takes a value corresponding (proportional) to the amplitude ap of the peak p. As shown (B) of FIG. 6, the function setting section 32 sets dissonance functions Fd at both sides (i.e., positive and negative sides) of each peak p in the spectral trajectory RA of the target sound VA using the frequency fp of that peak p as a setting basis (d=|f−fp|=0). Note that the dissonance functions Fd should not be limited such the function as shown in FIG. 6 and described above, but the dissonance functions Fd may be any type of such a function that the function has the greater peak amplitude ap at a point of the frequency difference d of 100 cents and down slopes descending from the peak amplitude ap toward an amplitude 0 (zero) at both sides of the point of the frequency difference d of 100 cents. In such a case, it is preferable to set the dissonance functions Fd so that the amplitude of the down slopes reaches to 0 (zero) at the frequency fp or a frequency adjacent to the frequency fp.

As shown in (A) of FIG. 4, the dissonance functions Fd set for some adjoining peaks p may overlap with each other on the frequency axis. As shown in (B) of FIG. 4, the first adjustment section 34 of FIG. 5 selects, as a degree of dissonance D0(*f*), the maximum value of degrees of dissonance w(d), at each frequency f on the frequency axis. Namely, as regards each frequency at which there is no overlap in dissonance function Fd, a degree of dissonance w(d) of the dissonance function Fd is selected as the degree of dissonance D0(*f*), while, as regards each frequency at which there is an overlap between a plurality of dissonance functions Fd, the maximum value of a plurality of degrees of dissonance w(d) at the frequency f is selected as the degree of dissonance D0(*f*).

The degree of dissonance D0(*f*) calculated through the aforementioned arithmetic operations sometimes may not become zero at the frequency fp of the peak q of the target sound VA. However, components of sounds which have a same or common frequency f naturally become consonant with each other, i.e. present a zero degree of dissonance D0(*f*). Thus, for each of the peaks p, the second adjustment section 36 of FIG. 5 subtracts the amplitude ap from the degree of dissonance D0(*fp*) at the frequency fp, as shown in (C) of FIG. 4.

The third adjustment section 38 of FIG. 5 further adjusts the degree of dissonance D0(*f*) ((C) of FIG. 4), having been adjusted by the second adjustment section 36, in such a manner that the maximum value takes a predetermined value k, to thereby calculate a degree of dissonance Dmask(f). More specifically, the third adjustment section 38 identifies the maximum value Dmax from among the degrees of dissonance D0(*f*) adjusted by the second adjustment section 36 (see (C) of FIG. 4) and calculates the degree of dissonance Dmask(f) by performing subtraction of the maximum value Dmax and addition of a predetermined value k on each of the degrees of dissonance D0(*f*) obtained throughout the entire range of the frequency axis. Namely, the arithmetic operations performed by the third adjustment section 38 can be expressed as follows:

$$D\text{mask}(f) = D0(f) - D\text{max} + k \quad (2)$$

Further, the third adjustment section 38 establishes an evaluating mask M by setting all degrees of dissonance D0(*f*) below zero at zero, as shown in (E) of FIG. 4. As shown in (D) of FIG. 4, the maximum value Dmax of the degree of dissonance Dmask(f) calculated by mathematical expression (2) above takes the predetermined value k. The predetermined value k is set at an experimentally or statistically suitable value (e.g., k=0.6) in accordance with a range of the amplitudes ap in the spectral trajectory RB of the evaluated sound VB that is to be compared with the evaluating mask M.

The evaluating mask M is generated in accordance with the aforementioned procedure, and thus, in a case where the evaluated sound VB contains a lot of components of frequencies f having high degrees of dissonance Dmask(f) defined in the evaluating mask M, the evaluated sound VB has a high possibility of being dissonant with the target sound VA. Thus, the index calculation section 60 of FIG. 2 calculates an index value of consonance (i.e., consonance index value) D between the target sound VA and the evaluated sound VB by collating between the evaluating mask M created from the target sound VA and the evaluated sound VB.

However, if the target sound VA and the evaluated sound VB do not coincide with each other in pitch range, a range of frequencies f having high degrees of dissonance Dmask(f) in the evaluating mask M and a range of frequencies fp of peaks p of the spectral trajectory RB differ from each other. Thus, even if the target sound VA and the evaluated sound VB are sounds musically dissonant with each other, the index value D calculated by the collation between the evaluating mask M and the spectral trajectory RB takes a small value (namely, the two sounds VA and VB are evaluated as consonant with each other). In order to avoid the above-mentioned non-coincidence, the correlation calculation section 40 and shift processing section 50 of FIG. 2 shift the spectral trajectory RB of the evaluated sound VB along the frequency axis so as to coincide with the pitch range of the target sound VA. Specific behavior of the correlation calculation section 40 and shift processing section 50 will be described below.

Figure 7:
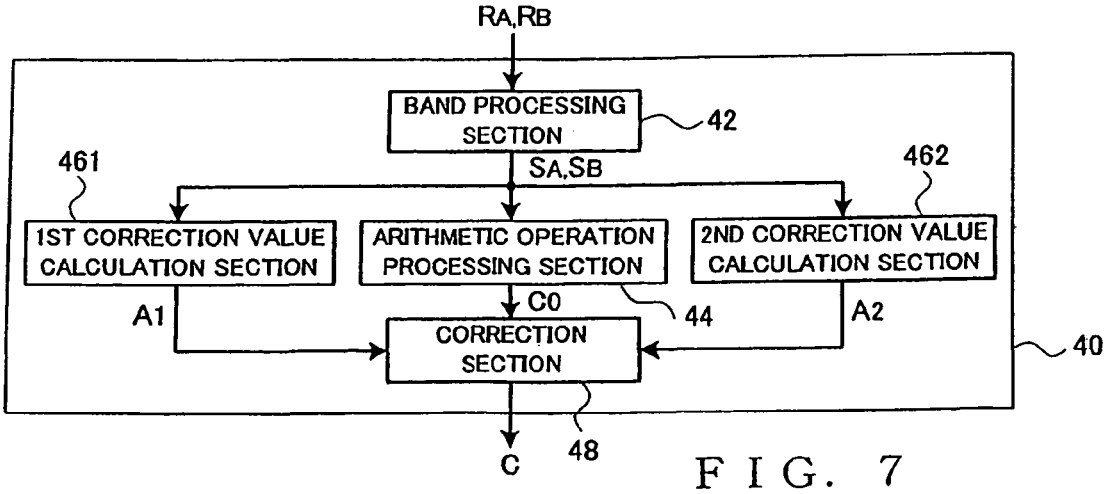
FIG. 7 is a block diagram of a correlation calculation section provided in the first embodiment of the sound processing apparatus.

The correlation calculation section 40 of FIG. 2 calculates a correlation value (cross-correlation value) C between the spectral trajectory RA of the target sound VA and spectral trajectory RB of the evaluated sound VB generated by the quantization section 24. As shown in FIG. 7, the correlation calculation section 40 includes a band processing section 42, an arithmetic operation processing section 44, a first correction value calculation section 461, a second correction value calculation section 462, and a correction section 48.

The band processing section 42 generates band intensity distributions S (SA and SB) from the spectral trajectories R (RA and RB) generated by the quantization section 24 per each of the unit portions TU. Namely, the band intensity distribution SA is generated from the spectral trajectory RA, while the band intensity distribution SB is generated from the spectral trajectory RB.

Figure 8:
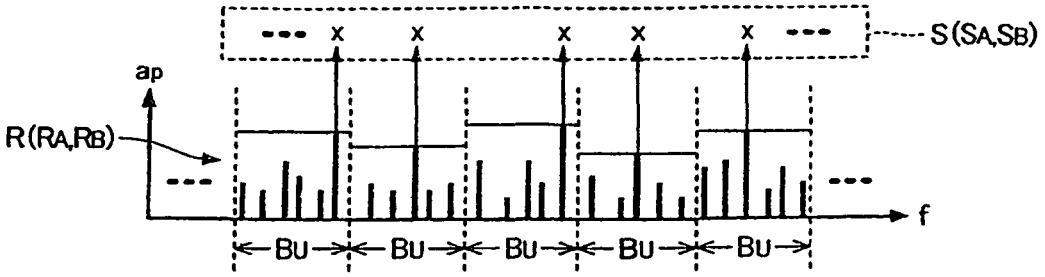
FIG. 8 is a conceptual diagram explanatory of how a band intensity distribution is generated.

As shown in FIG. 8, the intensity distributions S (SA and SB) are a train of numerical values where an intensity x is set per each of Nf (Nf is a natural number) bands (hereinafter referred to as "unit bands") BU obtained by dividing the spectral trajectories R (RA and RB). Each of the unit bands BU is set, for example, at a band width equal to one octave (1,200 cents). Further, the intensity x of each of the unit bands BU is set at a numerical value corresponding to amplitudes ap of components of the unit band BU in the spectral trajectories R. The intensity x in the illustrated example of FIG. 8 is the maximum value of the amplitudes ap in the spectral trajectories R within the unit band BU. Namely, the band intensity distribution SA is a train of numerical values where the maximum values of the amplitudes ap within the individual unit band widths BU in the spectral trajectory RA of the target sound VA are arranged as the intensities x of a plurality of the unit band widths BU, while the intensity distribution SB is a train of numerical values where the maximum values of the amplitudes ap within the individual unit band widths BU in the spectral trajectory RB of the evaluated sound VB are arranged as the intensities x of a plurality of the unit band widths BU. In an alternative, average values of the amplitudes ap within the individual unit band widths BU may be arranged as the intensities x of the intensity distributions S.

The arithmetic operation processing section 44 of FIG. 7 calculates a correlation value C0 between the band intensity distribution SA and the band intensity distribution SB generated by the band processing section 42. More specifically, the arithmetic operation processing section 44 calculates a correlation value C0 of a portion where the band intensity distribution SA and the band intensity distribution SB overlap each other on the frequency axis, while shifting the two intensity distributions SA and SB along the frequency axis so that a frequency difference Δf between the intensity distributions SA and SB changes. As shown in (A) of FIG. 9, the frequency difference Δf is sequentially changed, one unit band BU at a time, within a range from one position where only one unit band BU at one end (right end in (A) of FIG. 9) of the band intensity distribution SB overlaps the band intensity distribution SA (i.e., Δf=−(N−1)) to another position where only one unit band BU at the other end (left end in (A) of FIG. 9) of the band intensity distribution SB overlaps the band intensity distribution SA (i.e., Δf=N−1). If the frequency difference Δf is zero, it means that the band intensity distribution SA and the band intensity distribution SB completely overlap each other. As shown in (B) of FIG. 9, relationship between the frequency difference Δf and the correlation value C0 between the band intensity distribution SA and the band intensity distribution SB is calculated by the arithmetic operation processing section 44. There is a tendency that the correlation value C0 is maximized at the frequency difference Δf where the pitch range of the target sound VA and the pitch range of the target sound VB approach each other.

Because the correlation value C0 is calculated only for overlapping portions between the band intensity distribution SA and the band intensity distribution SB, the correlation value C0 calculated by the arithmetic operation processing section 44 may sometimes take a great value even where respective conspicuous components (components of great amplitudes within bands) of the band intensity distribution SA and band intensity distribution SB are present in portions of the band intensity distribution SA and the band intensity distribution SB that do not overlap with each other at the frequency difference Δf in question. However, if respective conspicuous components of the band intensity distribution SA and the band intensity distribution SB are present in non-overlapping portions between the distributions SA and SB as noted above, these band intensity distributions SA and SB should be evaluated as having a low correlation as a whole. In view of the foregoing, the correction section 48 in the instant embodiment corrects the correlation value C0, calculated by the arithmetic operation processing section 44, in accordance with intensities in the non-overlapping portions between the band intensity distributions SA and SB. More specifically, the correction section 48 lowers the correlation value C0 calculated by the arithmetic operation processing section 44 for the frequency difference Δf at which the components in the non-overlapping portions between the band intensity distributions SA and SB become conspicuous. The following paragraphs describe a specific example manner in which the correlation value C0 is corrected.

Figure 9:
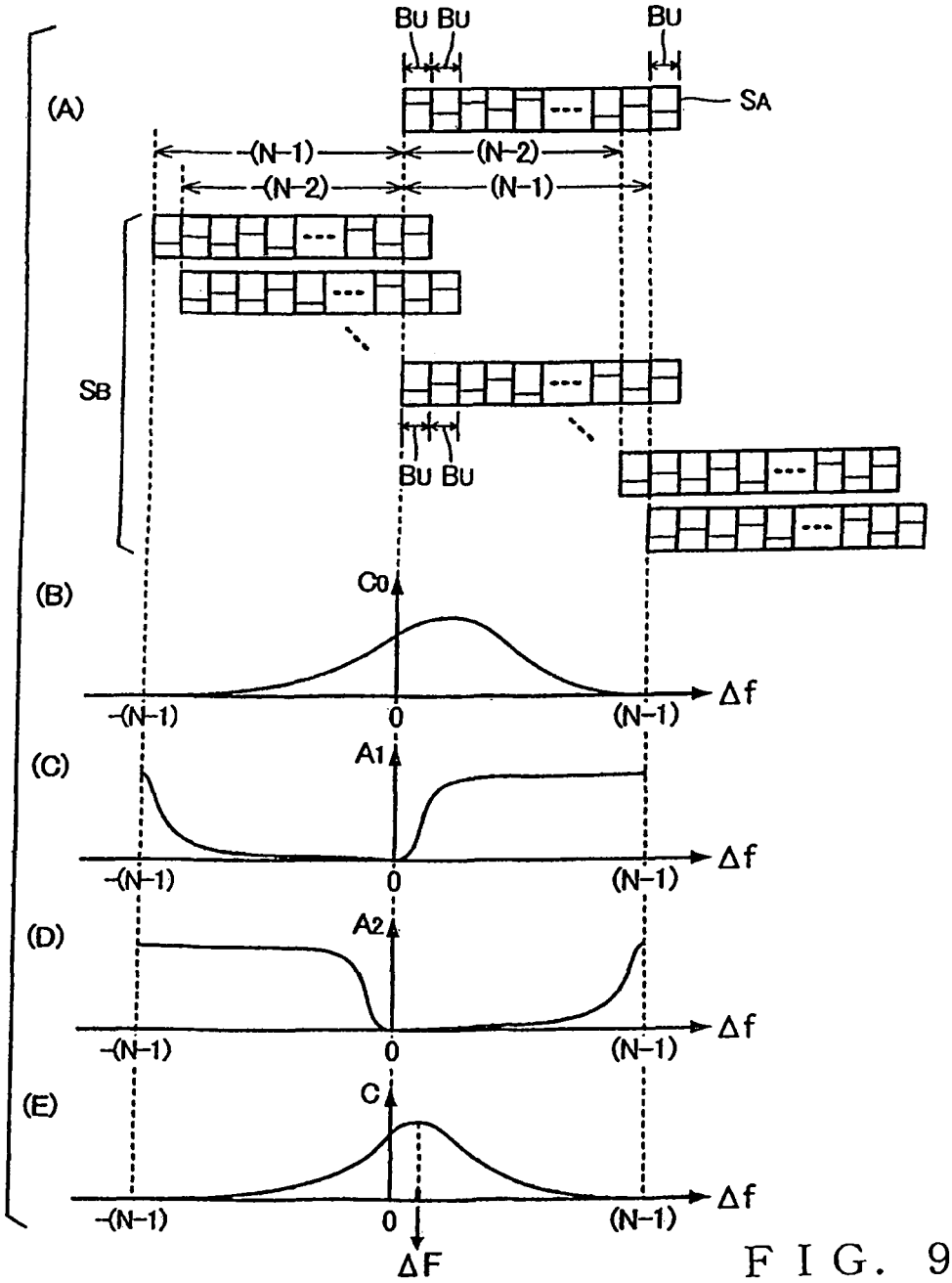
FIG. 9 is a conceptual diagram explanatory of behavior of the correlation calculation section.
Figure 10:
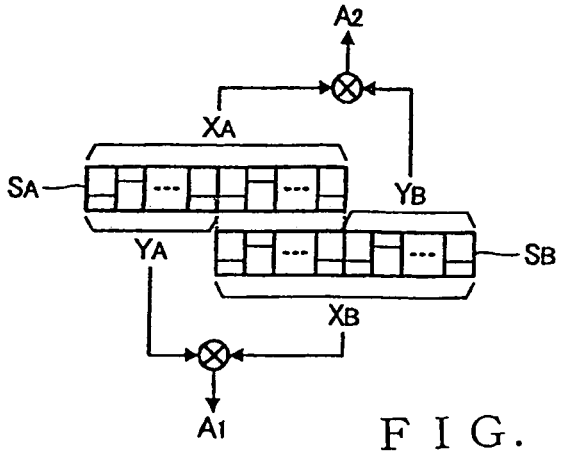
FIG. 10 is a conceptual diagram explanatory of how correction values are calculated.

The first correction value calculation section 461 of FIG. 7 calculates, for each frequency difference Δf, a correction value A1 to be used for correction of the correlation value C0 by the correction section 48. (C) of FIG. 9 shows a specific example of relationship between the correction value A1 and the frequency difference Δf. The correction value A1 increases as the amplitude in a portion of the band intensity distribution SA not overlapping with the band intensity distribution SB increases. As shown in FIG. 10, for example, the first correction value calculation section 461 calculates, for each of a plurality of frequency differences Δf, the correction value A1 by multiplying 1) a sum YA of the intensities x within unit bands BU of the band intensity distribution SA which do not overlap with the band intensity distribution SB with 2) a sum XB of the intensities x of all unit bands BU (Nf unit bands BU) of the band intensity distribution SB (A1=YA·XB).

Similarly, the second correction value calculation section 462 of FIG. 7 calculates, for each frequency difference Δf, a correction value A2 to be used for correction of the correlation value C0. (D) of FIG. 9 shows relationship between the correction value A2 and the frequency difference Δf. The correction value A2 increases as the amplitude in a portion of the band intensity distribution SB not overlapping with the band intensity distribution SA increases. As shown in FIG. 10, for example, the second correction value calculation section 462 calculates, for each of a plurality of frequency differences Δf, the correction value A2 by multiplying 1) a sum YB of intensities x within each unit band BU of the band intensity distribution SB not overlapping with the band intensity distribution SA with 2) a sum XA of intensities x of all of the unit bands BU (Nf unit bands BU) of the band intensity distribution BA (A2=YB·XA).

The correction section 48 calculates a corrected correlation value C by subtracting the correction values A1 and A2 from the correlation value C0 per each frequency difference Δf. (E) of FIG. 9 shows a specific example of relationship between the corrected correlation value C and the frequency difference Δf. The correlation value C per each frequency difference Δf is a numerical value determined by subtracting the correction values A1 and A2 for the frequency difference Δf from the correlation value C0 calculated by the arithmetic operation processing section 44 for the frequency difference Δf (i.e., C=C0−A1−A2). Thus, with the frequency difference Δf at which there is a high correlation between respective great-intensity (x) portions of the band intensity distribution SA and the band intensity distribution SB the correlation value C becomes maximum. Namely, if there is a correlation only between respective small-intensity (x) portions of the band intensity distribution SA and the band intensity distribution SB, it is difficult for the correlation value C to become maximum. For example, if the pitch range of the evaluated sound VB is one octave higher than that of the target sound VA, the correlation value C becomes maximum at a point where the frequency difference Δf is "1". The foregoing have described the construction and behavior of the correlation calculation section 40.

The shift processing section 50 of FIG. 2 shifts the spectral trajectory RB in the frequency axis direction so that the pitch range of the evaluated sound VB conforms with the pitch range of the target sound VA; the shifting of the spectral trajectory RB is executed individually for each of the unit portions TU. Namely, the shift processing section 50 shifts the spectral trajectory RB of each of the unit portions TU in the frequency axis direction by a shift amount ΔF corresponding to the correlation value C calculated by the correlation calculation section 40 for the unit portions TU. As shown in (E) of FIG. 9, the shift amount ΔF corresponds to the frequency difference Δf at which the correlation value C becomes maximum. (A) of FIG. 11 shows a time series of shift amounts ΔF determined by the shift processing section 50 for the individual unit portions TU.

Figure 11:
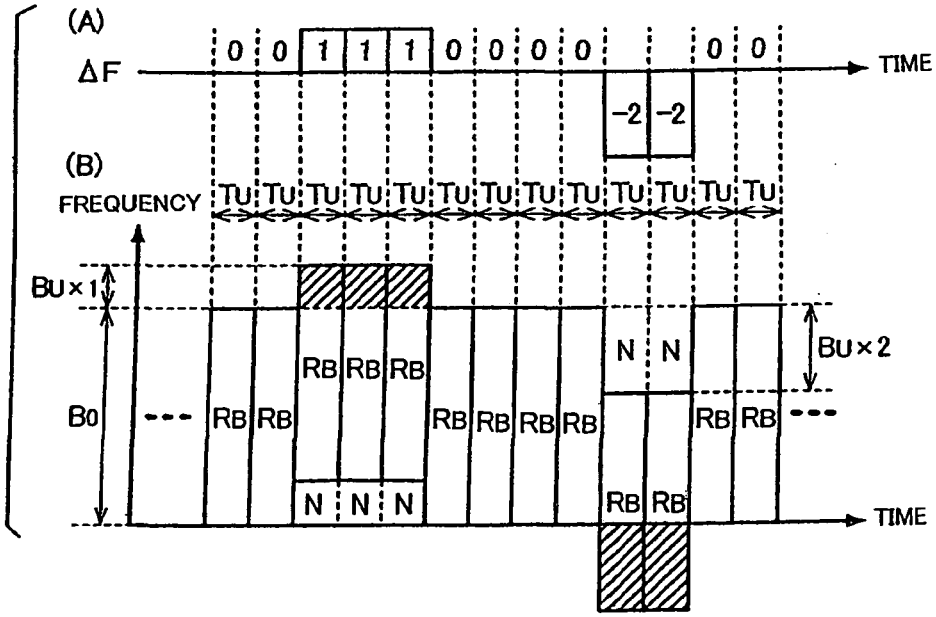
FIG. 11 is a conceptual diagram explanatory of behavior of a shift processing section provided in the first embodiment of the sound processing apparatus.

(B) of FIG. 11 is a schematic diagram showing a time series of the spectral trajectories RB having been processed by the shift processing section 50. Because the frequency difference Δf changes on a per-unit-band (BU) basis, the spectral trajectories RB are shifted in a positive or negative direction of the frequency axis by an amount equal to the bandwidth of the unit band BU (i.e., one octave) at a time. For example, if the shift amount ΔF is "1" the spectral trajectories RB are shifted in the positive direction of the frequency axis by an amount equal to one unit band BU (i.e., 1,200 cents equal to one octave), or if the shift amount ΔF is "−2", the spectral trajectories RB are shifted in the negative direction of the frequency axis by an amount equal to two unit bands BU (i.e., 2,400 cents equal to two octaves). Of the spectral trajectories RB, each portion (i.e., portion indicated by hatching in (B) of FIG. 11) having been shifted to outside of a predetermined number of bands B0 (i.e., N unit bands BU) due to the spectral trajectory shift is discarded. Further, of the bands B0, each portion where there is no longer any data due to the spectral trajectory shift (i.e., upstream portion in the shifting direction of the spectral trajectories RB) is filled with data z indicating that there is no peak p (i.e., amplitude ap is zero).

Figure 12:
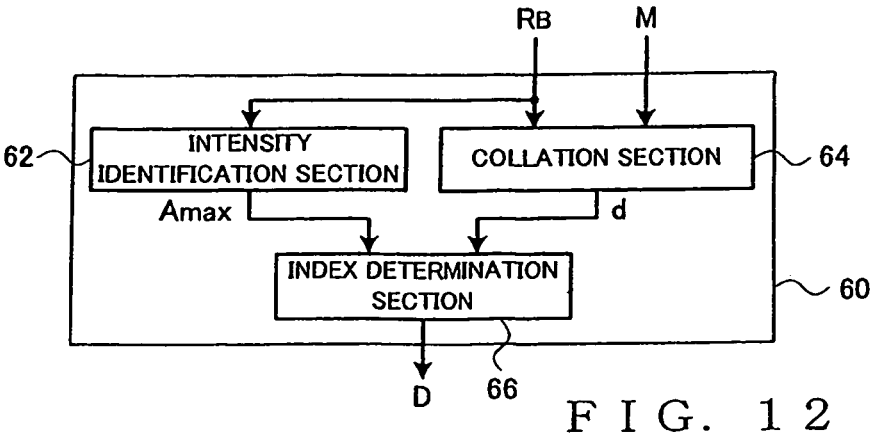
FIG. 12 is a block diagram of an index calculation section provided in the first embodiment of the sound processing apparatus.

The index calculation section 60 of FIG. 2 calculates a consonance index value D between the target sound VA and the evaluated sound VB by collating the spectral trajectories RB, having been processed by the shift processing section 50, with the evaluating mask M created by the mask generation section 30. As shown in FIG. 12, the index calculation section 60 includes an intensity identification section 62, a collation section 64 and an index determination section 66. The intensity identification section 62 identifies the maximum value Amax of the amplitudes ap of the peaks p from among the spectral trajectories RB (before or after the processing by the shift processing section 50) of all of the unit portions TU (i.e., Nt unit portions TU) of the evaluated sound VB.

The collation section 64 collates the spectral trajectory RB of each of the Nt unit portions TU with the evaluating mask M created from the spectral trajectory RA of the unit portion TU. More specifically, the collation section 64 calculates, for each of a plurality of bands Bq (each of 10 cents) of the spectral trajectories RB where there exists a peak p, calculates an index value d by multiplying (1) the degree of dissonance Dmask(fp) at the frequency fp of the peak p in the evaluating mask M and (2) the amplitude ap of the peak p in the spectral trajectory RB (d=Dmask(fp)·ap). The collation between the spectral trajectory RB and the evaluating mask M (i.e., calculation of the index value d per each band Bq) is performed for every one of the Nt unit portions TU of the evaluated sound VB.

Figure 13:
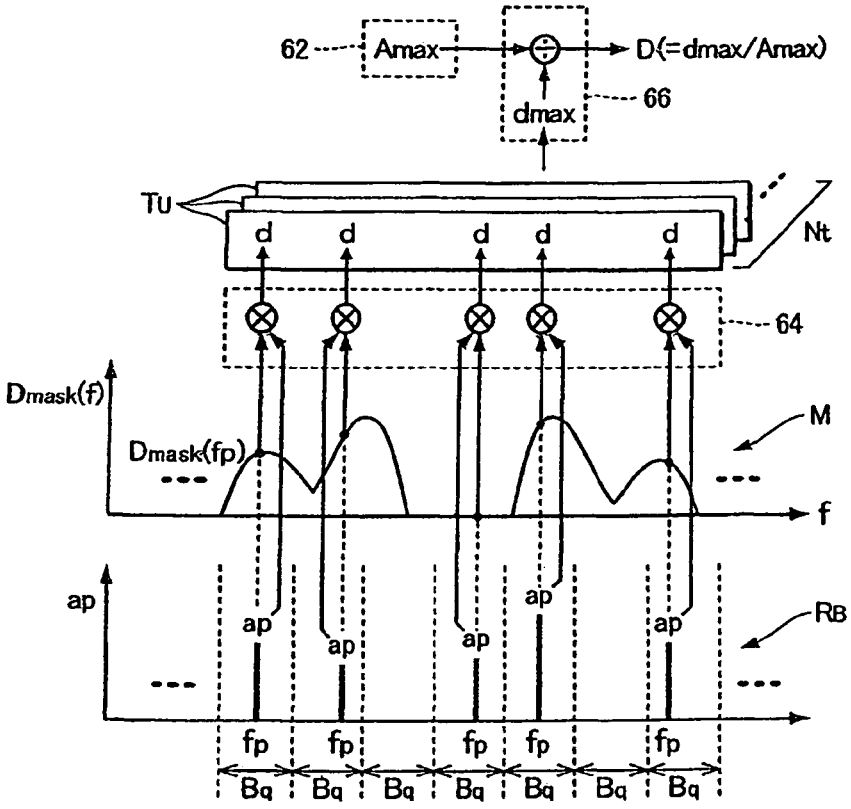
FIG. 13 is a block diagram of explanatory of behavior of the index calculation section.

As shown in FIG. 13, the index determination section 66 of FIG. 12 identifies the maximum value dmax of a plurality of the index values d calculated by the collation section 64, divides the thus-identified maximum value dmax by the maximum value Amax calculated by the intensity identification section 62 and then calculates a consonance index value D between the target sound VA and the evaluated sound VB (D=dmax/Amax). Although the index values d calculated by the collation section 64 depend on the tone volume of the evaluated sound VB, the consonance index value D is normalized to a value having a reduced dependence on the tone volume of the evaluated sound VB, by dividing the maximum value dmax of the index values d by the maximum value Amax of the amplitudes ap of the spectral trajectories RB. Of the evaluating mask M, the greater the degree of dissonance Dmask(fp) at the frequency fp of a peak p of a great amplitude ap in the spectral trajectories RB, the greater value the consonance index value D takes. As a consequence, an evaluated VB having a great consonance index value D can be evaluated to be a sound V difficult to be musically consonant with the target sound VA.

In the instant embodiment, as described above, a consonance index value D between the target sound VA and the evaluated sound VB is calculated using the evaluating mask M having a dissonance function Fd set for each of a plurality of peaks p in the spectral trajectory RA of the target sound VA. Thus, in principle, the instant embodiment can eliminate the need for detecting the fundamental frequencies of the target sound VA and evaluated sound VB. As a result, the instant embodiment can evaluate, with high accuracy, a degree of dissonance (or consonance) between the target sound VA and the evaluated sound VB even in the case where the target sound VA and the evaluated sound VB differ from each other in fundamental frequency or where a component of the fundamental frequency is missing from the target sound VA or from the evaluated sound VB.

Further, because the spectral trajectories RB of the evaluated sound VB are shifted along the frequency axis in such a manner than the pitch range of the target sound VA and the pitch range of the target sound VB approach each other, the instant embodiment can evaluate, with high accuracy, a degree of dissonance (or consonance) between the target sound VA and the evaluated sound VB even in the case where the target sound VA and the evaluated sound VB differ from each other in pitch range (e.g., where the target sound VA and the evaluated sound VB are performed on different musical instruments). Further, with the instant embodiment, where the corrected correlation value C based on the correction values A1 and A2 is used to determine a shift amount ΔF of the spectral trajectories RB, the pitch range of the target sound VA and the pitch range of the target sound VB can be caused to approach each other with high accuracy regardless of bands of the spectral trajectories RA and RB where there exist respective conspicuous components

Second Embodiment

The following describe a second embodiment of the sound processing apparatus of the present invention. In the following description about the second embodiment, the same elements as in the first embodiment are indicated by the same reference numerals and characters and will not be described here to avoid unnecessary duplication.

Figure 14:
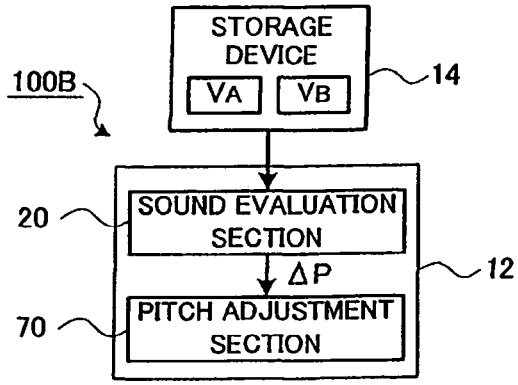
FIG. 14 a block diagram of a second embodiment of the sound processing apparatus of the present invention.

FIG. 14 is a block diagram of the second embodiment of the sound processing apparatus 100B of the present invention. As shown, the arithmetic operation processing device 12 functions as the sound evaluation section 20 and a tone pitch adjustment section 70. The sound evaluation section 20 in the second embodiment is generally similar to the sound evaluation section 20 in the first embodiment (FIG. 2), except that the index calculation section 60 in the second embodiment calculates a consonance index value D when each spectral trajectory RB, having been subjected to the process by the shift processing section 50, has been shifted on the frequency axis by a shift amount ΔP relative to the evaluating mask M, by performing the process of FIG. 13 per each of a plurality of changes of the shift amount ΔP, i.e. per each of a plurality of times when the shift amount ΔP has been changed. For example, the sound evaluation section 20 calculates 120 (one hundred and twenty) consonance index values D for the one evaluated sound VB, by sequentially changing the shift amount ΔP over the range of the band width of one unit band BU (i.e., 1,200 cents), a predetermined amount equal to the band Bq (i.e., 10 cents) at a time. Then, the sound evaluation section 20 identifies a shift amount ΔP of the spectral trajectories RB with which the plurality of (i.e., one hundred and twenty) consonance index values D become minimum (i.e., the evaluated sound VB becomes most consonant with the target sound VA).

The tone pitch adjustment section 70 of FIG. 14 changes or adjusts the tone pitch of the evaluated sound VB by the shift amount ΔP with which the consonance index values D become minimum. The tone pitch adjustment may be performed in any suitable conventionally-known technique. In the second embodiment arranged in the aforementioned manner, where the tone pitch of the evaluated sound VB is adjusted in such a way that the consonance index values D calculated by the sound evaluation section 20 become minimum, it is possible to generate an evaluated sound VB that is auditorily consonant with the target sound VA to a sufficient degree. Such an evaluated sound VB having been adjusted by the tone pitch adjustment section 70 can be suitably used, for example, for mixing or connection with a target sound VA or for composition of a new music piece. Whereas the second embodiment of the sound processing apparatus 100B has been described as shifting the spectral trajectories RB by the shift amount ΔP, it may be constructed to calculate a plurality of consonance index values D by sequentially shifting the evaluating masks M on the frequency axis with the spectral trajectories RB fixed.

Third Embodiment

Figure 15:
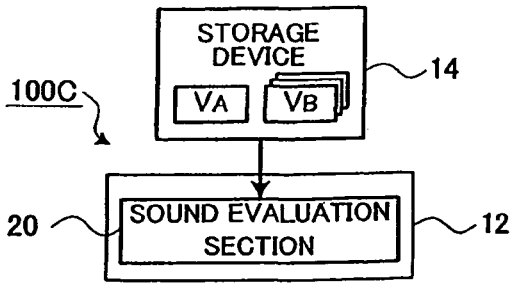
FIG. 15 a block diagram of a third embodiment of the sound processing apparatus of the present invention.

FIG. 15 is a block diagram of a third embodiment of the sound processing apparatus 100C of the present invention. As shown, a plurality of evaluated sounds VB, which present waveforms of different sounds, are stored in the storage device 14. The sound evaluation section 20 in the third embodiment calculates consonant index values D individually for each of the plurality of evaluated sounds VB in generally the same manner as in the above-described first embodiment.

The sound evaluation section 20 selects an evaluated sound VB of which the calculated consonant index values D are minimal (i.e., which is most consonant with a target sound VA) from among the plurality of evaluated sounds VB stored in the storage device 14. Namely, in the third embodiment, it is possible to extract, from among the plurality of evaluated sounds VB, an evaluated sound VB sufficiently auditorily consonant with the target sound VA. Such an evaluated sound VB identified by the sound evaluation section 20 can be suitably used, for example, for mixing or connection with the target sound VA or for composition of a new music piece.

Whereas the third embodiment of the present invention has been described above as selecting one evaluated sound VB, it may be constructed to select a plurality of evaluated sounds VB ranked high in descending order of the consonant index values D (and use these selected evaluated sounds for mixing or connection with the target sound VA). Further, the arrangements of the second embodiment may be applied to the third embodiment. For example, regarding one of the plurality of evaluated sounds VB, stored in the storage device 14, for which the consonance index values D become minimum, a shift amount ΔP with which the consonant index values D become minimum with respect to the target sound VA may be determined in generally the same manner as in the second embodiment so that the tone pitch adjustment section 70 changes the tone pitches of the evaluated sounds VB by the shift amount ΔP.

<Modification>

The above-described embodiments may be modified variously. Specific example modifications will be set forth below, and two or more of these modifications may be combined as desired.

(1) Modification 1:

Whereas each of the embodiments has been described above as constructed to calculate spectral trajectories R (RA and RB) at the time of the calculation of the consonant index values D, it is also advantageous to calculate and store, in the storage device 14, spectral trajectories R of individual sounds V (target and evaluated sounds VA and VB) in advance. In the case where a plurality of evaluated sounds VB are collated with a target sound VA as in the above-described third embodiment, it is particularly advantageous to calculate and store in advance spectral trajectories R of a plurality of sounds V (target and evaluated sounds VA and VB), with a view to reducing the time required for calculation of the spectral trajectories R of each of the sounds V at the time of the calculation of the consonant index values D. Further, it is also advantageous to employ a construction where spectral trajectories R calculated by an external apparatus are supplied to the arithmetic operation processing device 12 via a communication network or via a portable storage or recording medium; in this case, the frequency analysis section 22 and quantization section 24 are omitted from the sound evaluation section 20. In the aforementioned modification where spectral trajectories R are prepared in advance, sounds V need not be stored in the storage device 14. Whereas the foregoing have described the storage and supply of spectral trajectories R, there may be employed another modified construction where band intensity distributions S (SA and SB) too are stored in advance in the storage device 14 or supplied from an external apparatus.

(2) Modification 2:

The way in which the index calculation section 60 calculates a consonance index value D may be modified as appropriate. For example, there may be employed a modified construction where index calculation section 60 calculates a consonance index value D by the collation section 64 by averaging index values d, calculated per each spectral trajectory RB, over Nt unit portions TU. Namely, the present invention may advantageously employ a modified construction where a consonance index value D is calculated through collation between the spectral trajectory RB of the evaluated sound VB and the evaluating mask M, and relationship between results of the collation between the spectral trajectory RB and the evaluating mask M and calculated consonance index values D may be defined in any desired form or manner. Further, whereas each of the embodiments has been described above as constructed to determine the maximum value of index values d as a consonance index value D, there may be advantageously employed a modified construction where the minimum value of index values d as a consonance index value D (i.e., where a greater consonance index value D is set as the degree of consonance between target and evaluated sounds VA and VB increases). Namely, the consonance index value D is defined as an index indicative of a degree of either consonance or dissonance between the target and evaluated sounds VA and VB, and relationship between increase/decrease of the degree of consonance or dissonance and increase/decrease of the degree of the consonance index value D may be defined in any desired form or manner.

(3) Modification 3:

In a case where there is no problem concerning a difference in pitch range between a target sound VA and an evaluated sound VB (e.g., where the target sound VA and the evaluated sound VB coincide with each other in pitch range), the correlation calculation section 40 and shift processing section 50 are dispensed with. Further, whereas each of the embodiments has been described above as constructed to calculate a correlation value C between band intensity distributions SA and SB of target and evaluated sounds VA and VB, the present invention may be constructed to calculate a correlation value C between a spectral trajectory RA (or spectral spectra QA, qA of a target sound VA and a spectral trajectory RB (or spectral spectra QB, qB of a target sound VB.

(4) Modification 4:

Further, whereas each of the embodiments has been described above as constructed to use spectral trajectories A (RA and RB), having been quantized by the quantization section 24, there may be employed a modified construction where frequency spectra q (qA and qB) calculated by the conversion section 221 are used in place of the spectral trajectories R (RA and RB) (namely, where the adjustment section 223 and quantization section 24 are omitted), or a modified construction where frequency spectra Q (QA and QB) having been adjusted by the adjustment section 223) are used in place of the spectral trajectories R (RA and RB) (namely, where the quantization section 24 is omitted).

This application is based on, and claims priority to, JP PA 2008-164057 filed on 24 Jun. 2008. The disclosure of the priority application, in its entirety, including the drawings, claims, and the specification thereof, is incorporated herein by reference.

What is claimed is:

1. A sound evaluation device for evaluating a degree of consonance or dissonance between a plurality of sounds, the sound evaluation device comprising:

a mask generation section that generates an evaluating mask indicative of a degree of dissonance with a first sound per each frequency along a frequency axis, by setting, for each of a plurality of peaks in spectra of said first sound, a dissonance function indicative of a relationship between a frequency difference from the peak and a degree of dissonance with a component of the peak; and an index calculation section that collates spectra of a second sound with the evaluating mask to thereby calculate a consonance index value indicative of a degree of consonance or dissonance between said first sound and said second.

2. The sound evaluation device as claimed in claim 1 wherein the spectra of said first sound are supplied as a spectral trajectory comprising a time-series arrangement of spectra, said mask generation section generates a time-series trajectory of the evaluation masks;

the spectra of said second sound are supplied as a spectral trajectory comprising a time-series arrangement of spectra, and said index calculation section collates the spectral trajectory of said second sound with the trajectory of the evaluating masks.

3. The sound evaluation device as claimed in claim 1 which further comprises:

a correlation calculation section that calculates a correlation value between the spectra of said first sound and the spectra of said second sound; and a shift processing section that shifts the spectra of said second sound, in a direction of the frequency axis, by a given frequency difference such that the correlation value calculated by said correlation calculation section becomes maximum, and wherein said index calculation section collates the spectra of said second sound, having been processed by said shift processing section, with the evaluating mask.

4. The sound evaluation device as claimed in claim 3 wherein said correlation calculation section includes:

a band processing section that generates a band intensity distribution of said first sound indicative of a spectral intensity of each predetermined unit band of said first sound and generates a band intensity distribution of said second sound indicative of a spectral intensity of each predetermined unit band of said second sound; and an arithmetic operation processing section that calculates, per each frequency difference corresponding to the unit band, a correlation value between the band intensity distribution of said first sound and the band intensity distribution of said second sound.

5. The sound evaluation device as claimed in claim 4 wherein said correlation calculation section further includes:

a first correction value calculation section that calculates, for each of the frequency differences between said first sound and said second sound, a first correction value corresponding to a sum of the intensities in a portion of the band intensity distribution of said first sound that does not overlap with the band intensity distribution of said second sound;

a second correction value calculation section that calculates, for each of the frequency differences between said first sound and said second sound, a second correction value corresponding to a sum of the intensities in a portion of the band intensity distribution of said second sound that does not overlap with the band intensity distribution of said first sound; and a correction section that, for each of the frequency differences, subtracts the first and second correction values from the correlation value calculated by said arithmetic operation processing section and thereby corrects the correlation value.

6. The sound evaluation device as claimed in claim 1 wherein, when a plurality of the dissonance functions overlap each other on the frequency axis, said mask generation section generates the evaluating mask by selecting a maximum value of the degree of dissonance at the frequency in the plurality of the dissonance functions.

7. The sound evaluation device as claimed in claim 1 wherein said mask generation section generates the evaluating mask by adding or subtracting a predetermined value to or from the degree of dissonance of the dissonance function set on the frequency axis.

8. The sound evaluation device as claimed in claim 1 wherein said index calculation section includes:

an intensity identification section that identifies a maximum value of amplitudes of the peaks in the spectra of said second sound;

a collation section that multiplies, for each of the frequencies, each of the amplitude of the spectral trajectory of said second sound and each numerical value of the evaluating mask, to thereby output a product for each of the frequencies; and an index determination section that determine a consonance index value by dividing a maximum value of the products, outputted by said collation section, by the maximum amplitude value identified by said intensity identification section.

9. The sound evaluation device as claimed in claim 1 wherein said index calculation section calculates the consonance index value for each of a plurality of cases where the spectra of said second sound have been shifted by different shift amounts in the direction of the frequency axis, and which further comprises a tone pitch adjustment section that changes a tone pitch of said second sound by a given shift amount such that the degree of consonance indicated by the consonance index value becomes maximum.

10. The sound evaluation device as claimed in claim 1 wherein said index calculation section collates each of a plurality of the second sounds with the evaluating mask, to thereby calculate a consonance index value for each of the second sounds.

11. A sound evaluation method for evaluating a degree of consonance or dissonance between a plurality of sounds, the method comprising:

generating an evaluating mask indicative of a degree of dissonance with a first sound per each frequency along a frequency axis, by setting, for each of a plurality of peaks in spectra of said first sound, a dissonance function indicative of relationship between a frequency difference from the peak and a degree of dissonance with a component of the peak; and collating spectra of a second sound with the evaluating mask to thereby calculate a consonance index value indicative of a degree of consonance or dissonance between said first sound and said second sound.

12. A non-transitory machine readable medium containing a program executable by a computer to perform a sound evaluation method for evaluating a degree of consonance or dissonance between a plurality of sounds, the method comprising:

generating an evaluating mask indicative of a degree of dissonance with a first sound per each frequency along a frequency axis, by setting, for each of a plurality of peaks in spectra of said first sound, a dissonance function indicative of relationship between a frequency difference from the peak and a degree of dissonance with a component of the peak; and collating spectra of a second sound with the evaluating mask to thereby calculate a consonance index value indicative of a degree of consonance or dissonance between said first sound and said second sound.

* * * * *